US011466467B2

(12) United States Patent
Kowalski

(10) Patent No.: US 11,466,467 B2
(45) Date of Patent: Oct. 11, 2022

(54) MODULAR CONSTRUCTION SHELTER

(71) Applicant: Nicholas L. Kowalski, Traverse City, MI (US)

(72) Inventor: Nicholas L. Kowalski, Traverse City, MI (US)

( * ) Notice: Subject to any disclaimer, the term of this patent is extended or adjusted under 35 U.S.C. 154(b) by 603 days.

(21) Appl. No.: 16/441,431

(22) Filed: Jun. 14, 2019

(65) Prior Publication Data

US 2020/0248469 A1 Aug. 6, 2020

Related U.S. Application Data

(60) Provisional application No. 62/799,117, filed on Jan. 31, 2019.

(51) Int. Cl.
*E04G 21/28* (2006.01)
*E04G 5/12* (2006.01)

(52) U.S. Cl.
CPC ..... *E04G 21/28* (2013.01); *E04G 5/12* (2013.01)

(58) Field of Classification Search
CPC ..... E04G 21/28; E04G 5/12; E04G 21/24
USPC ..... 160/371, 373
See application file for complete search history.

(56) References Cited

U.S. PATENT DOCUMENTS 3,121,470 A 2/1964 Stone et al.
3,586,126 A 6/1971 Eickhof
3,995,715 A * 12/1976 Virtanen ..... E04G 5/12 182/129
4,416,928 A * 11/1983 Carl ..... A01G 13/0231 428/38
4,738,335 A 4/1988 Ishii
4,815,562 A * 3/1989 Denny ..... E04G 21/24 182/138
4,986,389 A * 1/1991 Halligan, Sr. ..... E04G 21/28 182/138
5,038,889 A 8/1991 Jankowski
5,414,950 A * 5/1995 Johnson, Sr. ..... A01M 31/025 135/119

(Continued)

FOREIGN PATENT DOCUMENTS

DE 10013545 A1 * 9/2001 ..... E04G 21/28
GB 2455887 A * 7/2009 ..... E04G 21/28

*Primary Examiner* — Beth A Stephan
(74) *Attorney, Agent, or Firm* — Mitchell Intellectual Property Law, PLLC

(57) ABSTRACT

A modular construction shelter for protecting workers and equipment or building materials adjacent a building wall. The shelter comprises a plurality of substantially identical lightweight panels that can be interconnected interchangeably into wall and roof sections. Each panel comprises a rectangular frame of flat-edged frame members covered by a lightweight sheet of flexible weatherproof cover material such as clear plastic, with interconnection features such as aligned bores for clips or bolts formed through the frame members behind the plastic sheeting to secure the panels to one another. Each flexible weatherproof cover includes an overlap flap of the sheet material extending beyond lower and first-side edges of the frame, the overlap flap including interior-facing fastener material to mate with corresponding exterior-facing fastener material formed on the outside faces of the upper and second-side frame members of adjacent panels.

4 Claims, 8 Drawing Sheets

(56) References Cited

U.S. PATENT DOCUMENTS

| | | | | |
|---|---|---|---|---|
| 5,547,010 | A * | 8/1996 | Stuart | A47H 1/18 160/335 |
| 5,613,543 | A | 3/1997 | Walton | |
| 5,778,999 | A * | 7/1998 | Nealeigh | E04G 21/28 182/129 |
| 5,966,877 | A * | 10/1999 | Hawes | E04G 21/28 52/3 |
| 8,061,098 | B2 * | 11/2011 | Whelan | B32B 33/00 52/409 |
| 9,004,145 | B2 * | 4/2015 | Toledo | E04B 2/76 160/351 |
| 2002/0095898 | A1 | 7/2002 | Bettencourt | |
| 2006/0010815 | A1 * | 1/2006 | Dixon | E04G 21/28 52/514 |
| 2006/0225960 | A1 | 10/2006 | Ferlin et al. | |
| 2013/0318889 | A1 | 12/2013 | Brown et al. | |

* cited by examiner

MODULAR CONSTRUCTION SHELTER

RELATED APPLICATIONS/PRIORITY BENEFIT CLAIM

This application claims the benefit of U.S. Provisional Application No. 62/799,117 filed Jan. 31, 2019 by the same inventor (Kowalski), the entirety of which provisional application is hereby incorporated by reference.

FIELD

The subject matter of the present application is in the field of weather shelters for construction workers while they finish the exterior walls of buildings.

BACKGROUND

Construction workers finishing the exterior walls of buildings with siding, paint, or other materials are often exposed to unpleasant weather, often while working on or under scaffolding. Shielding the workers from the weather often entails covering the scaffolding with tarps. Tarps, however, are difficult to anchor against the wind and often fit poorly on the scaffolding, with significant gaps and sloppiness.

Attempts have been made in the prior art to supply better weather coverings for use with scaffolds, such as attachment systems and devices for raising plastic sheeting over the scaffolding, or rigid covers adapted to be attached to the scaffolding.

U.S. Pat. No. 3,121,470 to Stone et al. shows a protective cover for scaffolding in the form of sheet material such as canvas or polyethylene plastic. Brackets are used for detachably securing the sheet material to the frame of the scaffolding.

U.S. Pat. No. 3,586,126 to Eickhof shows a system for forming a partial enclosure about a scaffold frame by supporting and rolling/unrolling plastic sheeting over the framework.

U.S. Pat. No. 4,738,335 to Ishii shows a scaffolding system comprising parapet wall hooks on the top of a building, hanging stages suspended from the parapet wall hooks by cables, and protective nets stretched between the parapet wall hooks and the hanging stages with means for lifting and lowering the nets.

U.S. Pat. No. 5,038,889 to Jankowski shows a scaffold enclosure with a plurality of flexible translucent panels secured to the scaffolding frame with straps, and to each another with strips of hook-and-loop material at the panel edges.

U.S. Pat. No. 5,613,543 to Walton shows a system of supports and fabric or plastic panels erected to provide a continuous temporary covering against the side of a building, comprising tubular support framing over which fabric or plastic sheeting can be controllably raised and lowered with a winch and cables.

U.S. Pub. No. 2002/0095898 A1 to Bettencourt shows a modular temporary building frame tarp system, with an array of prefabricated rectangular tarp panels that can be fastened directly to the exposed frame of an unfinished building.

U.S. Pub. No. 2006/0225960 A1 to Ferlin et al. shows an enclosed scaffolding assembly covered by sound-attenuating sheets to define an enclosed work area adjacent a building.

U.S. Pub. No. 2013/0318889 A1 to Brown et al. shows a modular insulated scaffold wall system, with walls comprising a plurality of wall panels placed into customized tracks secured to a scaffold floor, and wall and ceiling panels with insulated sleeves. The system allows for multiple levels of temporary insulated areas to be erected within a scaffold.

BRIEF SUMMARY

The present invention is a modular weather shelter system for protecting workers working on the exterior of a building wall. In general the system comprises a plurality of weatherproof wall (and optionally roof) panels that can be quickly joined together into a shelter next to a building wall, with or without scaffolding, to form a lightweight, solid, temporary, weather-tight weather barrier or enclosure.

In a first form, wall and roof panels are substantially identical and comprise substantially rigid, lightweight rectangular frames with flexible weatherproof sheeting secured to the frames. The frames are formed from rectangular or flat-edged frame members that mate with each other in a stable configuration, the frame members joined with clips or pins or other mechanical connectors at their abutting edges.

A wall formed from a plurality of joined panels may rest on the ground, optionally staked in place. The wall may be further stabilized in a vertical position by an angled roof formed from a row of panels joined at their lower ends to the upper edges of the upper wall panels. The upper ends of the roof panels rest against or on the exterior wall or roof edge of the building. The roof panels are preferably joined to the upper wall panels with hinges, so that the angle of the roof can easily be adjusted against a building by adjusting each of the roof panels relative to their respective wall panels.

The weatherproof flexible sheeting on each panel has an L-shaped or right-angled extension defining overlap "flaps" extending in unsecured fashion beyond the panel frame at the lower edge and at a first-side edge of the panel. The overlap flaps at each edge include a hook-and-loop or equivalent fastener strip on an interior face thereof. The upper edges and second side edges of mating (adjacent) panels have mating fastener strips secured over the exterior faces of their respective frame members. The overlap flaps of the sheeting on a first panel can accordingly be secured to the outer face of the upper edge of a second panel beneath the first panel, and to the outer face of the second side edge of a third panel next to the first panel. When the flaps are secured over adjacent panels of a shelter wall and roof formed by a plurality of the interconnected panels, the overlapping flaps form weatherproof joints that also add structural integrity to the shelter. Overlap flaps on the end of a shelter wall or roof can be wrapped around their respective frame members and secured in place to prevent flapping.

In a further form, the shelter system comprises vertical reinforcement members having a height equal to two or more wall panels. The vertical reinforcement members are configured to be clipped or otherwise mechanically secured to the exposed frame members on the ends of a shelter wall for additional strength.

These and other features and advantages of the invention will become apparent from the detailed description below, in light of the accompanying drawings.

DETAILED DESCRIPTION

Figure 1:
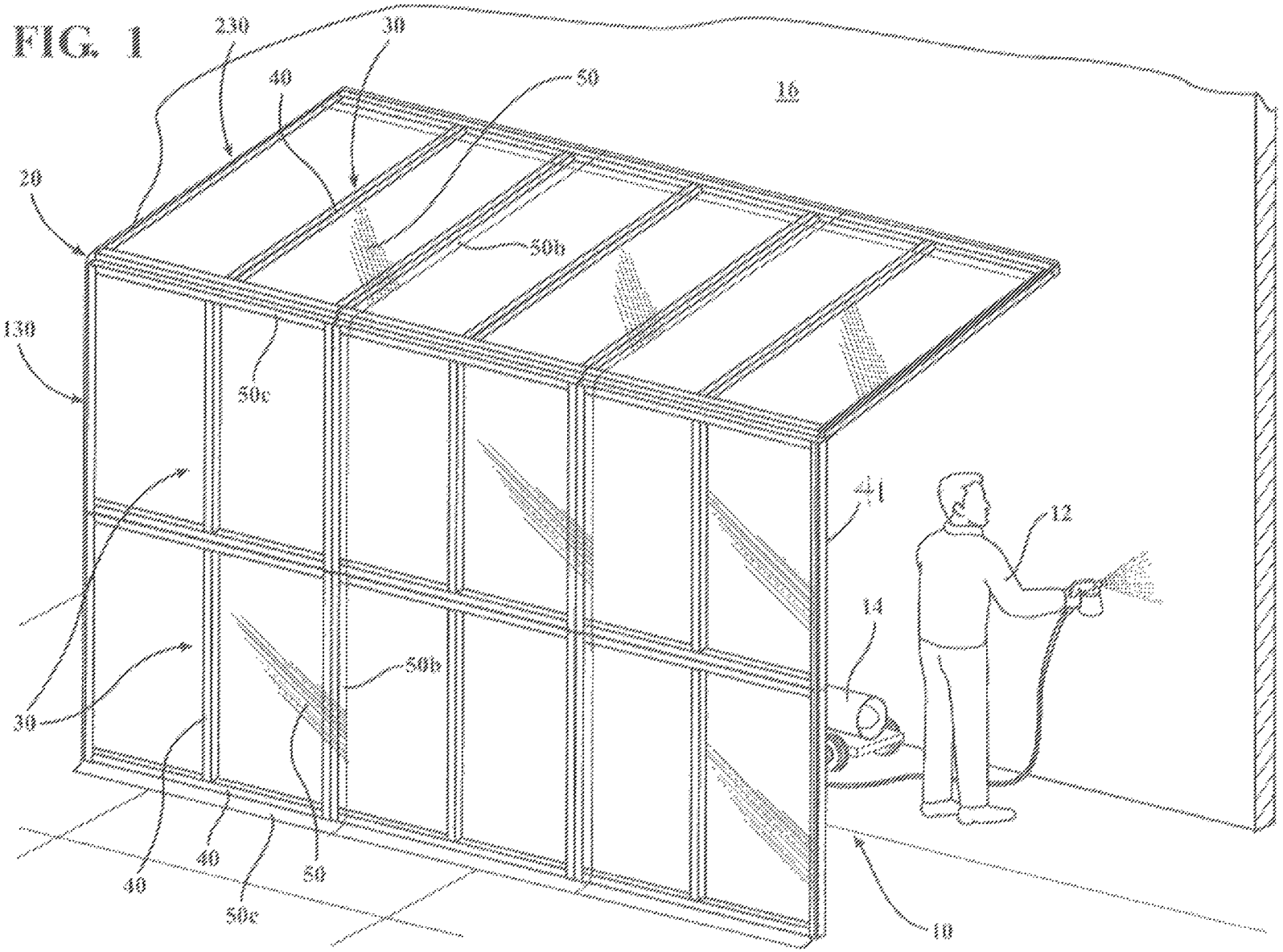
FIG. 1 is a perspective view of a weather shelter formed according to the invention, erected adjacent an exterior wall of a building.
Figure 2:
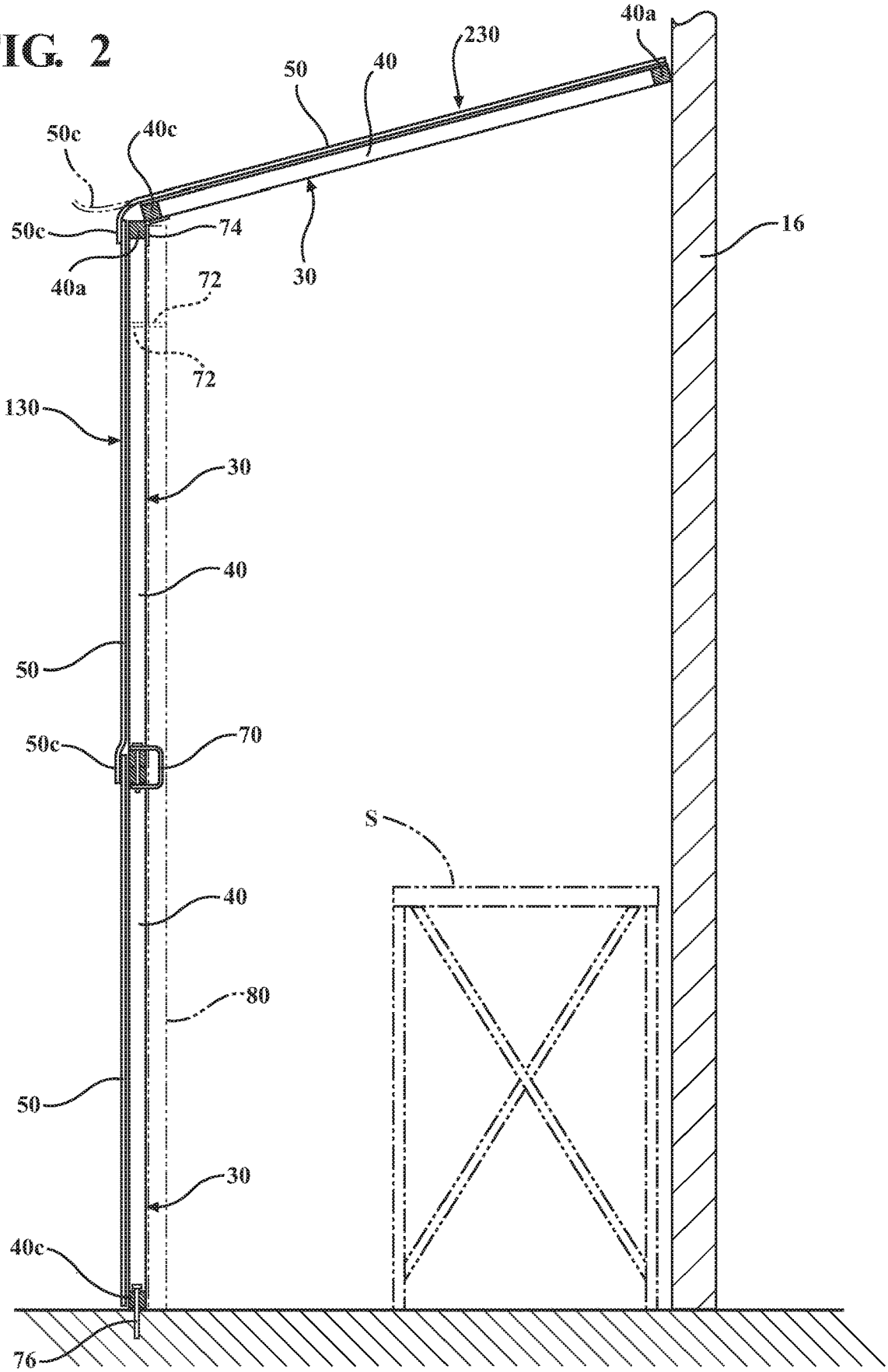
FIG. 2 is an end view of the shelter of FIG. 1.
Figure 3:
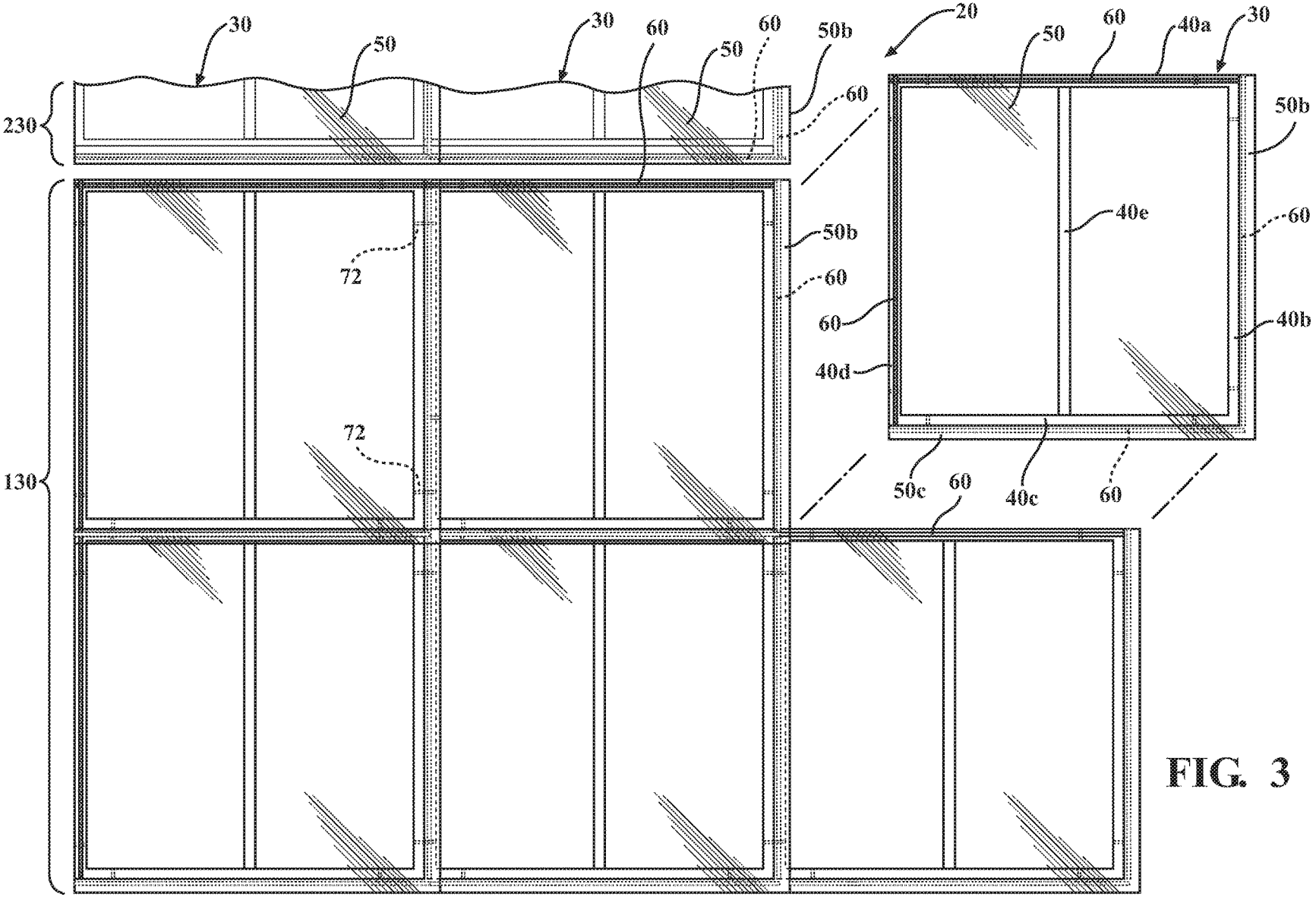
FIG. 3 is a front elevation view of the shelter of FIG. 1, with some of the wall and roof panels exploded in assembly.

Referring first to FIGS. 1-3, a work area 10, worker 12, and equipment 14 adjacent a wall 16 of a residential or commercial building are protected from weather by a temporary shelter 20 according to the invention. Shelter 20 is shown in exemplary form in order to teach how to make and use the claimed invention.

Shelter 20 comprises a plurality of substantially identical rectangular panels 30 capable of being temporarily joined to one another at their mating edges to form a shelter wall 130 and a shelter roof 230. The resulting temporary structure is a strong, lightweight, and weatherproof structure. Panels 30 each comprise an array of substantially rigid frame members 40, for example made from aluminum or stiff plastic tubing, covered by weatherproof, flexible (and preferably translucent) sheet material 50 such as strong clear plastic film of suitable thickness, for example clear polyethylene sheeting of 4-6 mils, secured to the outer faces of the frame members 40 of each panel. The frame members 40 preferably have a rectangular cross-section, or at least flat mating outer or side edges 41 so that they abut one another evenly and so that the joined panels define a substantially continuous planar outer surface over the respective wall or roof portions of the exterior of shelter 20. The panel dimensions 30 in the illustrated example are on the order of 4-ft by 4-ft (48 inches by 48 inches), but the sizing and rectangular shape may vary provided they remain a convenient size for being set up by small construction crews.

Figure 4:
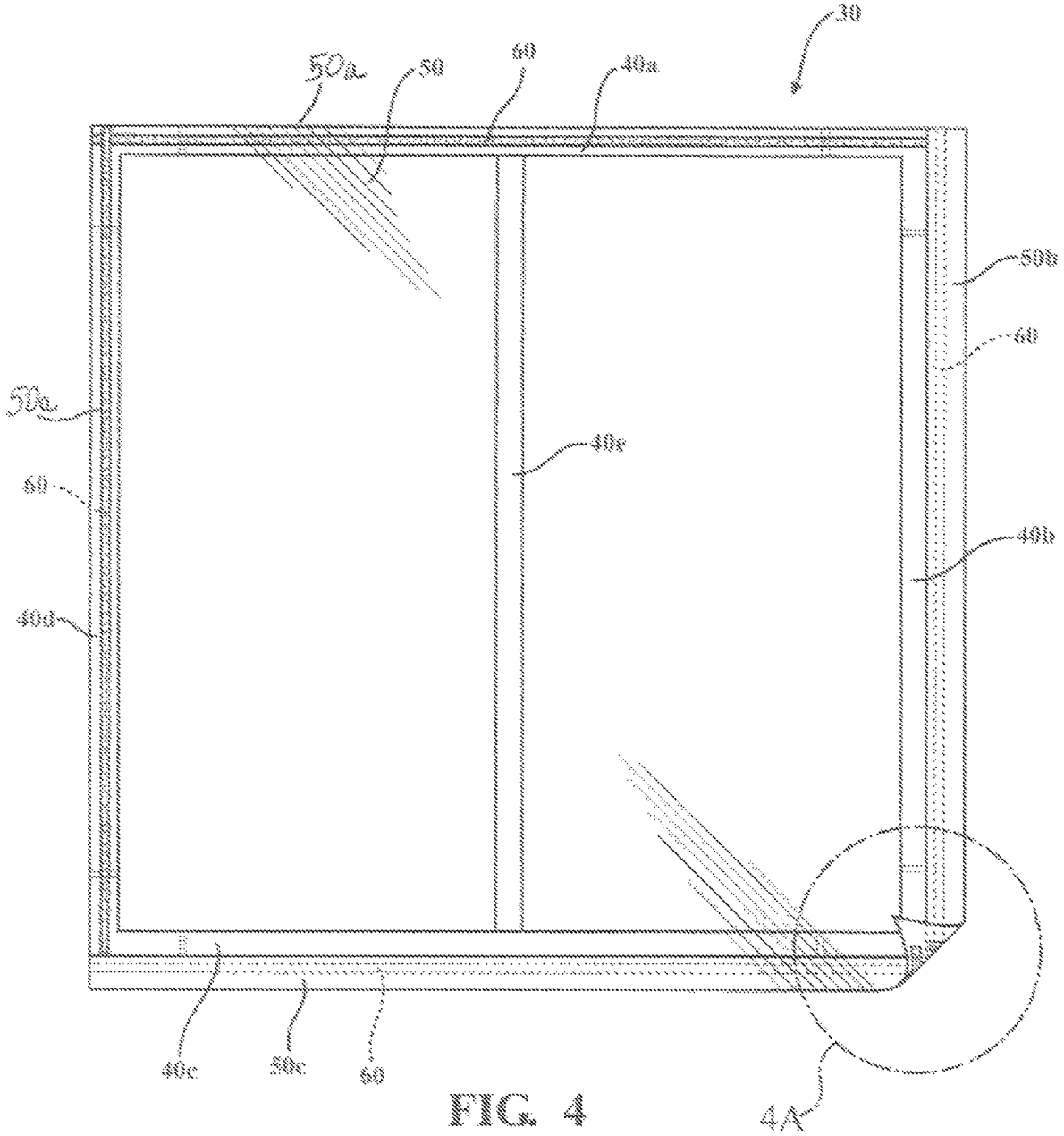
FIG. 4 is a front elevation view of one of the panels of FIG. 1.
Figure 4A:
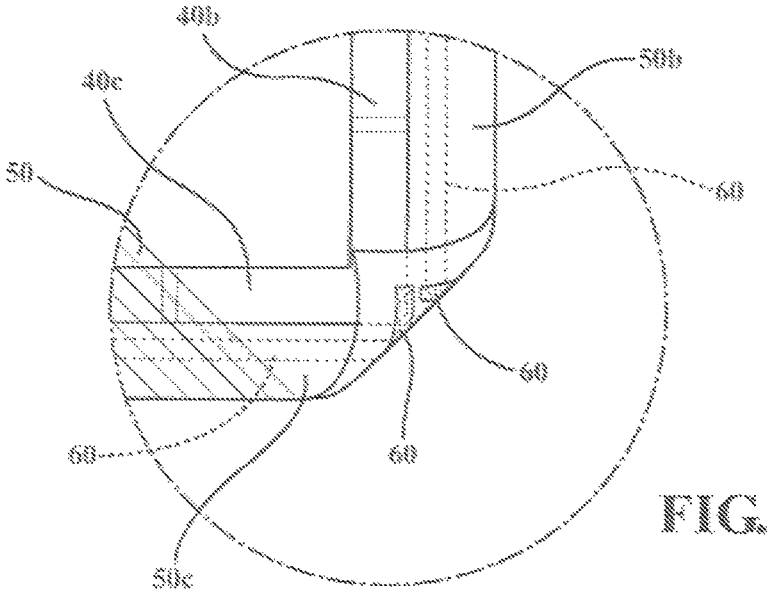
FIG. 4A is a detail view of flap portions of the panel of FIG. 4.

FIGS. 4 and 4A show a single panel 30 in more detail, with an upper frame member 40*a*, a first-side frame member 40*b*, a lower frame member 40*c*, and a second-side frame member 40*d*. One or more optional interior frame members 40*e* may be included for additional rigidity in the frame 40 and for additional support to the flexible sheeting 50. The frame members 40 forming the structure of a panel 30 may be joined in any manner, including but not limited to mechanical connections, adhesives, welds, or by being integrally molded or joined together, depending on the material used for the frame members. Flexible sheeting 50 may be secured to the outer faces of the frame members, for example with staples, adhesive, screws, or gasket and gasket-receiving grooves of the type used in screen doors.

Flexible sheeting 50 includes sides corresponding to those of the underlying frame 40: upper side 50*a*, first-side 50*b*, lower side 50*c*, and second-side 50*d*. However, first-side 50*b* and lower side 50*c* extend beyond their corresponding frame members 40*b* and 40*c* to define unstructured, flexible, overlap flap portions or "flaps" 50*b* and 50*c* having a width sufficient to overlap the joint between mated frame members 40 on adjacent panels 30, and to further overlie and cover some or all of the exterior face of the adjacent frame member 40 on the adjacent panel 30.

As shown in the illustrated example, the overlap flaps 50*b* and 50*c* preferably comprise a continuous, one-piece, L-shaped extension of the flexible sheeting 50; i.e., sheeting 50 for panel 40 is formed as a rectangle with dimensions that extend beyond the first-side and lower frame members 40*b* and 40*c* to form the overlap flaps. Alternately it would be possible to form the overlap flaps as separately-movable or separate flaps to form the L-shaped overlap extension of the flexible sheeting, for example with a gap or slit separating the flaps 50*b* and 50*c* where they meet at the corner of frame 40, or with the lower end of the first-side overlap flap 50*b* overlapping the end of the bottom side overlap flap 50*c* so that the overlap flaps are able to be fastened and unfastened to adjacent panel frame members independently of one another.

The exterior-facing front faces of upper side frame members 40*a* and second-side frame members 40*d* are faced with relatively flat fastener "strips" 60, for example hook-and-loop material or magnetic strips or self-adhering plastic film or other known equivalents, which may be continuous strips or spaced patterns of fastener material spaced along the length of the frame member and facing outwardly. The inner-facing sides of overlap flaps 50*b* and 50*c* are faced with mating fastener "strips" 60 in a corresponding inward-facing configuration or array sufficient to form a strong connection when mated with outward-facing strips 60 on adjacent panel frame members, for example continuous strips 60 of equal length with those on the adjacent frame members 40, or spaced strips or pieces of fastener in a pattern corresponding to a spaced pattern on the adjacent frame member 40. The outward-facing fastener strips 60 on the frame members may be secured to the frame members 40 using staples or screws, adhesives, etc., either directly to the frame members or over/through the flexible sheeting 50 attached to the frame members. The inner-facing fastener strips 60 on the inside faces of the overlap flaps 50*b*, 50*c* may be secured to the flexible sheeting material with adhesives, sewing, known heat- or sonic-type welding techniques, or any other known method.

Figure 5:
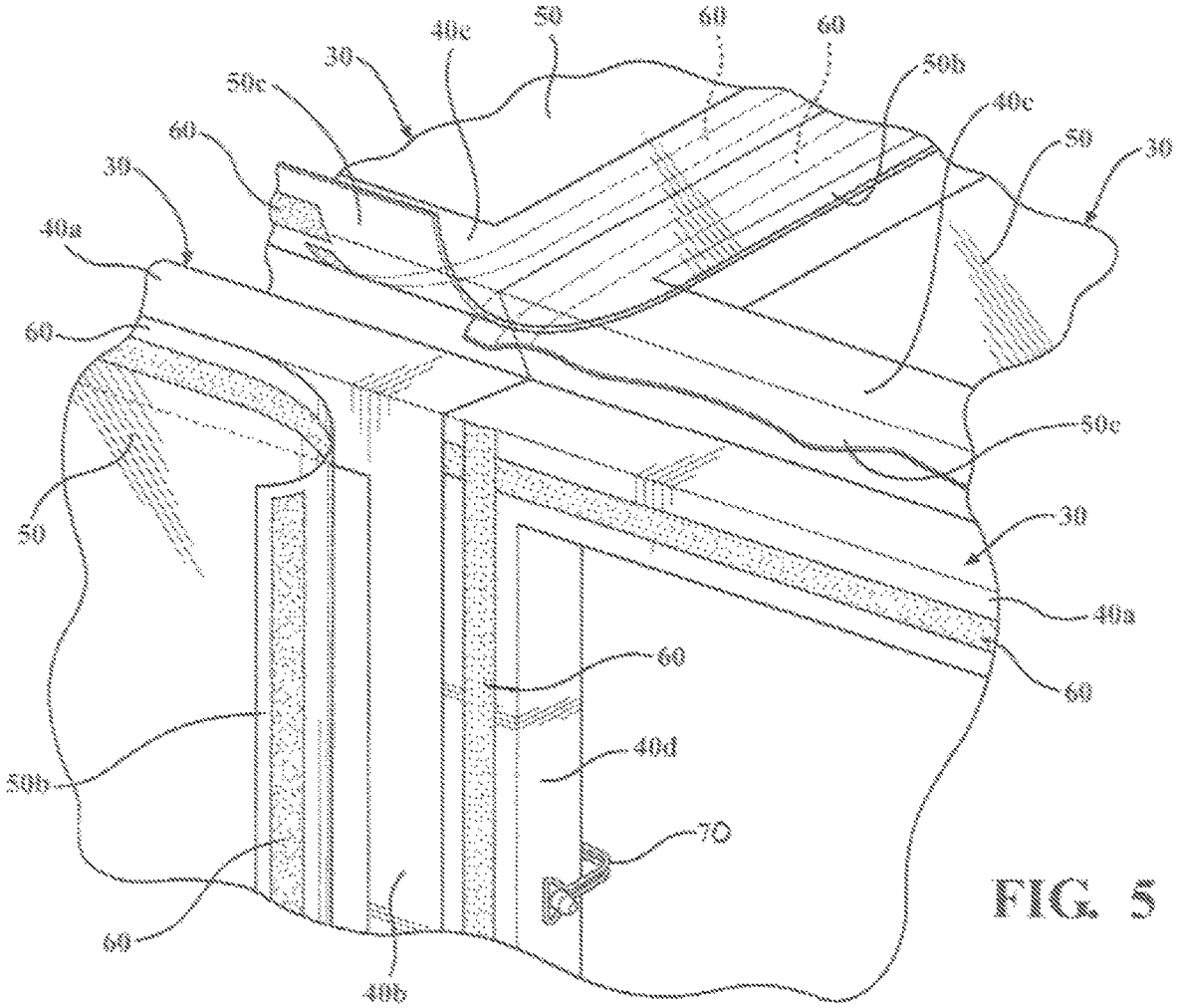
FIG. 5 is a detail perspective view of overlapping flap connections between adjacent wall and roof panels of the shelter of FIG. 1.

It is also possible to form each sheet or panel of flexible sheeting material 50 with both the outward-facing and inward-facing fastener strips 60 already attached, and then to secure the flexible sheeting 50 to the panel's frame members 40 as shown in FIGS. 4 & 5, or to secure overlapping portions of two or more flexible sheets 50 to each other, as shown in FIG. 2. "Strips" is accordingly used herein as shorthand for any pattern or arrangement of mating fastener material along the inside faces of the overlap flaps and the outside faces of the mating frame members.

Figure 6:
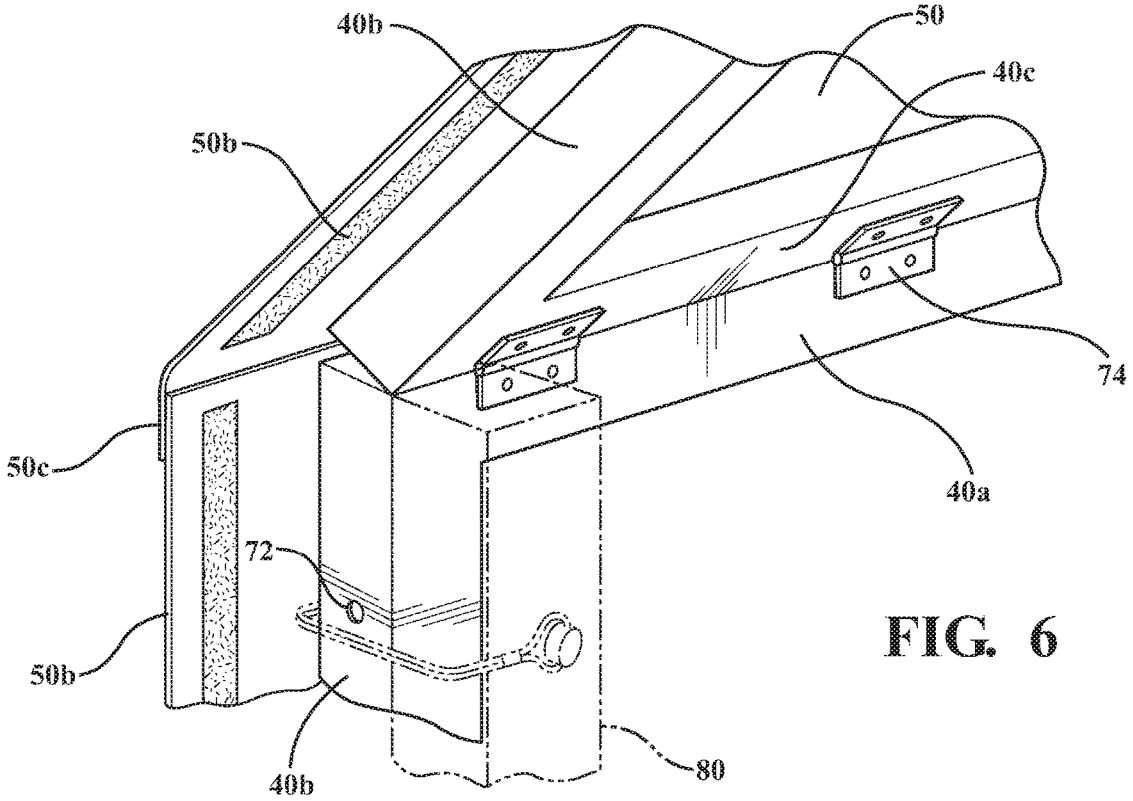
FIG. 6 is an interior perspective view of an overlapping flap connection over the hinged joint of an adjacent roof panel and wall panel of the shelter of FIG. 1.
Figure 7:
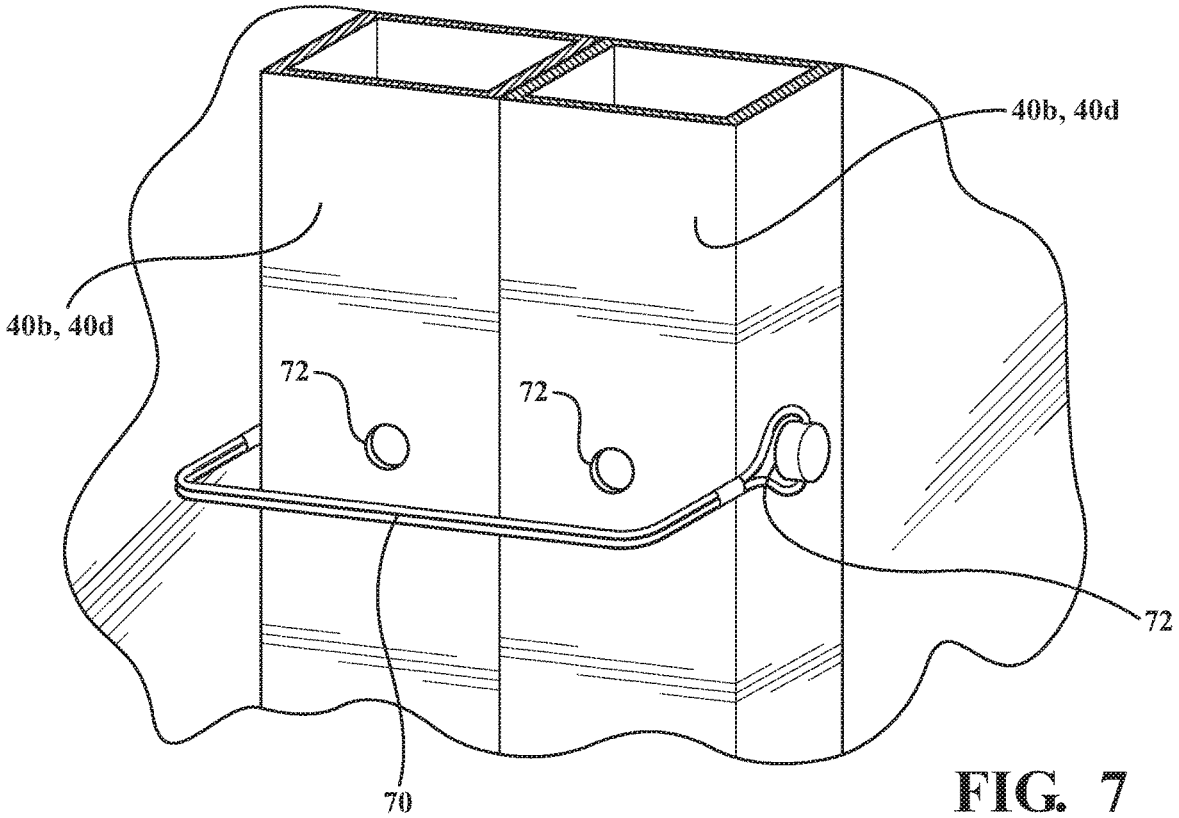
FIG. 7 is a detail perspective view of a clip-and-pin connection between the frame members of two adjacent panels of the shelter of FIG. 1.

Referring to FIGS. 3, 6, and 7, wall and roof panels 30, which are substantially identical, have a primary structural connection to one another at mating edges using strong mechanical connectors such as U-clips 70 inserted side-to-side on the rear sides of the panels 30 through aligned bores 72 formed in the frame members 40 as shown in the illustrated example. Other types of releasable connector could alternately be used, for example screws or bolts.

A shelter wall 130 can be formed by joining multiple panels 30 side-to-side and top-to-bottom as shown in FIGS. 1-3, using the aforementioned connectors 70. Wall 130 can be stabilized in a more or less vertical position relative to building wall 16 by an angled shelter roof 230 formed from a row of interconnected roof panels 30 and further connected at their lower ends to the upper end of wall 130 and extending at an upward angle to rest against the building wall 16. In the illustrated example, each roof panel 30 is connected to an adjacent upper frame member 40*a* of a wall panel 30 beneath it by one or more hinges 74, for example common door-type hinges, in order to make the angle of the roof panel adjustable relative to the vertical wall 130. Hinges 74 can be attached temporarily to the adjacent frame members 40*a* and 40*c* with screws or other suitable fasteners.

Once panels 30 have been formed into a shelter 20 with a wall 130 and roof 230, the weatherproofness and the structural integrity of the shelter overall is enhanced by engaging the free, flexible overlap flaps 50*b* and 50*c* of each panel 30 with the fastener material 60 on the exterior faces of the adjacent frame members 40*a*, 40*d* of the adjacent panels below and to the side. The inner-facing fastener strip 60 on each overlap flap is simply mated onto the outward-facing strip 60 on the adjacent frame member, overlying the joint between the frame members on the mated panels 30, including the angled joint between the upper ends of the wall panels and the lower ends of the hinged roof panels. Any free overlap flaps at the end or bottom of the shelter wall 130 can hang or drape freely, or can be wrapped around or underneath the underlying frame member and secured behind the panel or staked or weighted to the ground. It may be desirable to make the width of the overlap flaps 50*b*, 50*c* wider than the width of the adjacent frame members, for example as shown in FIG. 6, in order to allow some extra width for spanning the gap created at the angled roof/wall junction and/or to wrap around the frame members at the open ends of the shelter wall and roof.

The stability of shelter 20 may further be enhanced by staking the lower edge of wall 130 (the row of bottom frame members 40*c* on the lower row of panels 30) to the ground, for example by inserting stakes 76 (FIG. 2) through the bores 72 formed in the bottom frame members that are not occupied by U-clips). The upper ends of roof 230 (the row of upper frame members 40*a* against the building) may be secured against the building with screws or brackets or similar if putting holes in the siding or framing of the building wall 16 or the roof edge is not an issue during the particular phase of construction.

For additional stability, the vertical frame members of the panels of the shelter wall 130 can be reinforced with vertical reinforcing pins or tubes 80 or similar with a height corresponding to the height of the wall, e.g. two panels high in the illustrated example. These vertical reinforcing pins 80 may be formed of the same material and cross-section as the frame members 40 in the panels 30, such as rectangular aluminum tubing, and may have corresponding structural mating features such as bores 72 spaced and aligned to correspond to the U-clip bores 72 formed in frame members 40 so that the same U-clips 70 can be used to secure them to the sides or interior faces of the vertical frame members 40 on at least the ends of the shelter wall and optionally to the interior faces of some or all of the vertically-aligned frame members 40 in the shelter wall. Vertical reinforcing members 80 may additionally be staked to the ground, or may have stake-like extensions formed on their lower ends to be inserted into the ground.

Figure 8:
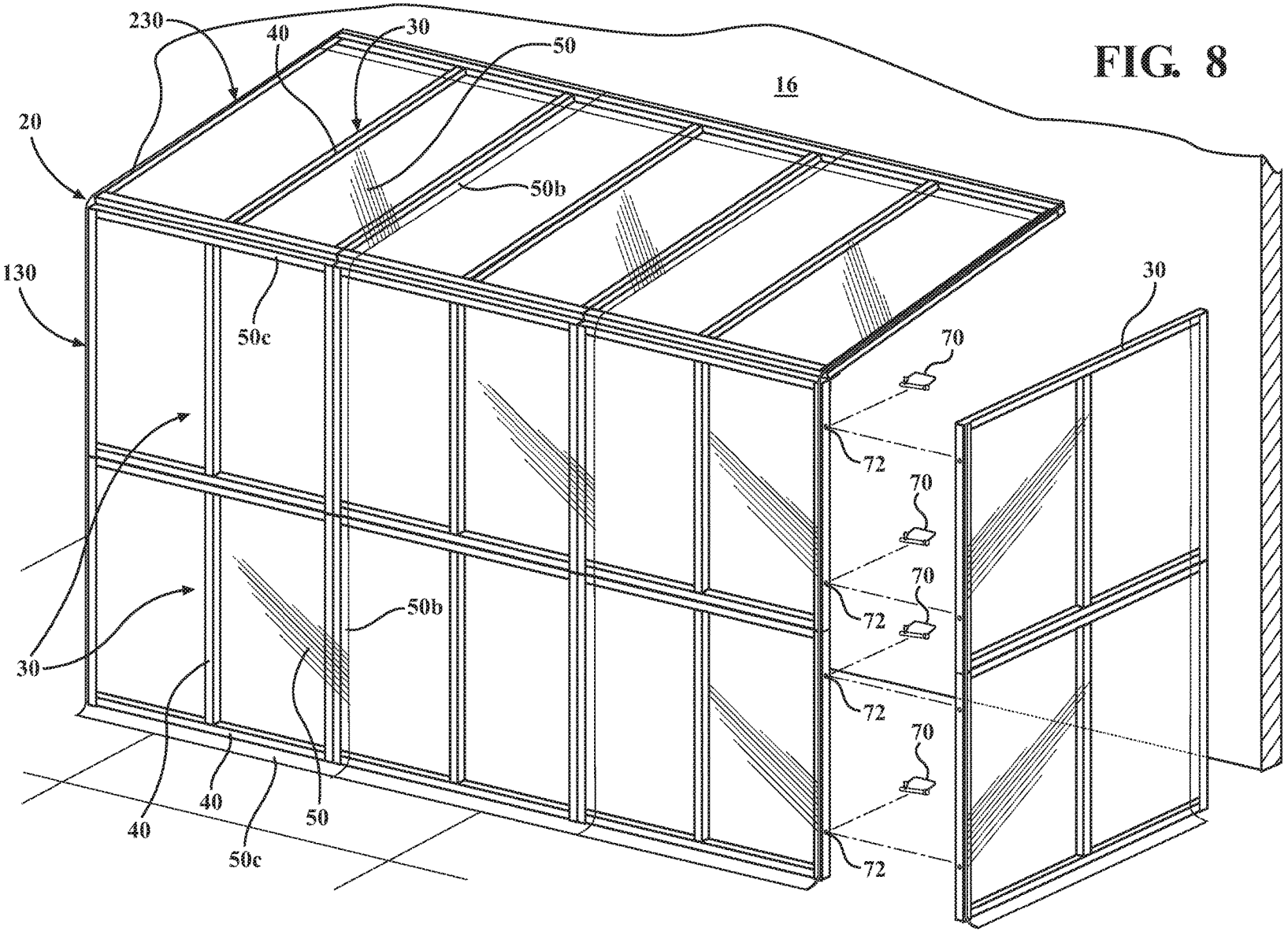
FIG. 8 is similar to FIG. 1, showing an end panel joined at 90 degrees to partially enclose an end of the shelter wall.
Figure 9:
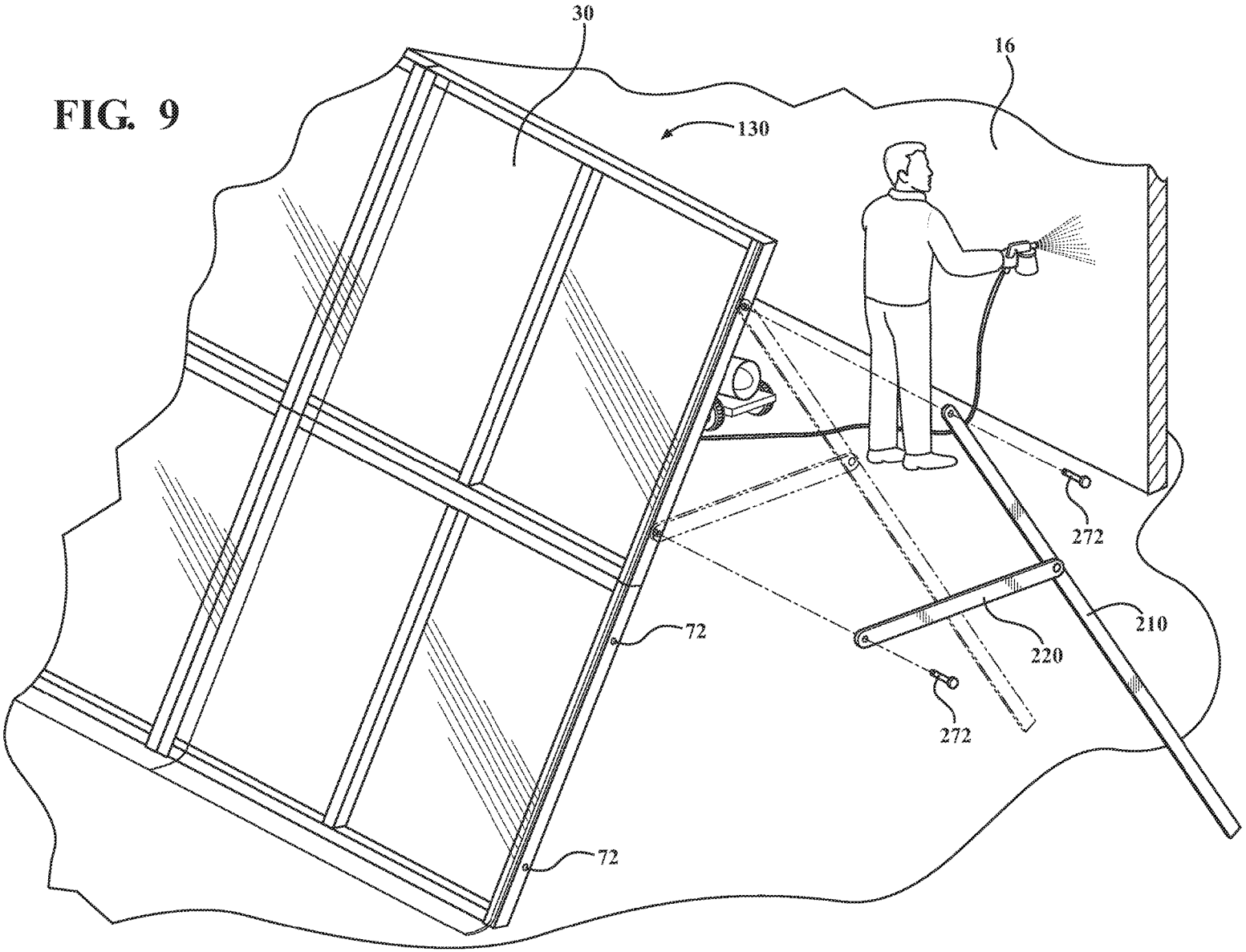
FIG. 9 is an end perspective view of a shelter wall similar to that in FIG. 1, supported in an A-frame configuration on optional swivel arms.

Referring to FIGS. 8 and 9, two alternate ways to use panels 30 are illustrated.

Referring to FIG. 8, additional bores 72 may be formed on the inside faces of the frame members 40 (as best shown in FIG. 7) so that panels 30 may be connected at 90-degree angles using the U-clips 70, for example to partially or fully close off one or both ends of a shelter wall 130. The overlap flaps or flap portions 50*b* on the side edges of the panels 30 may be wrapped around the 90-degree angle of the abutting frame members 40 and connected to the adjacent frame member in essentially the same manner as described above for panels forming a flat wall, if wide enough; alternately, extension flaps may be added to the existing overlap flaps at the end of the shelter to comfortably wrap around the corner.

In FIG. 9, panels 30 may be configured at the upper ends of the side frame members 40*b*, 40*d* to pivotally attach removable swivel arms 210. In the illustrated example, swivel arms 210 are pivotally attached to each upper end of each of the outermost side frame members 40 at the end of a shelter wall 130, for example via pivot pins/studs 272 extending into bores or holes 72 in the upper ends of the side frame members 40*b*, 40*d* in a secure, pivoting manner. The resulting wall 130 can be supported at an angle to form an A-frame wall structure leaning on the swivel arms 210 for a simple windbreak adjacent a work area. For additional stability, the lower ends of both the shelter wall 130 and the swivel arms 210 may be pinned or staked into the ground; alternately, or additionally, a removable brace 220 extending from each swivel arm 210 may be attached with pins 272 to the ends of the shelter wall via other holes 72 formed in the frame members.

DESCRIPTION OF OPERATION

In operation, the panels 30 can be disassembled and delivered to a jobsite in a compact, stacked package, for example in a pickup truck bed. The identical nature of the panels 30 allows them to be joined and assembled into a wall 130 and optionally also a roof 230 interchangeably at the jobsite, using U-clips or other connectors, and then sealed up tight and strengthened by engaging the overlap flaps of each panel with the exterior frame fastener strips on the adjacent panel frame members. Damage to the flexible sheeting 50 is easily repaired with tape or patches of sheeting material, and the individual covers 50 can easily be fully removed and replaced on a panel frame if desired.

While the illustrated shelter 20 formed from panels 30 is shown as self-supporting against the building, it will be understood by those skilled in the art that the interconnected panels 30 could secured to the exterior framework of existing, conventional scaffolding, for example by lashing a shelter wall 130 or roof section 230 comprising two or more connected panels 30 to the corresponding outer side of the scaffolding with rope or cable ties. Alternately, as shown schematically in phantom in FIG. 2, a shelter wall 130 (and optional roof section 230) could be assembled around an existing scaffold S without any structural connection thereto, the shelter 20 supporting itself against the building wall or on an A-frame as described above; or a scaffold structure could be erected behind or underneath a previously assembled shelter 20 without any structural connection to the shelter. Another use for panels 30 is to attach them directly to siding or window frames to temporarily cover open windows.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. A modular weather shelter system for protecting workers working on the exterior of a building wall, comprising a plurality of substantially identical weatherproof panels that can be quickly joined together into a shelter next to a building wall to form a lightweight, temporary, weather-tight enclosure, each of the panels comprising:

a substantially rigid, lightweight rectangular frame with a weatherproof flexible sheeting secured over an exterior of the frame;

the frame comprising upper, first-side, bottom, and second-side flat-edged frame members configured to abut adjacent frame members on adjacent panels of the plurality of panels in a stable configuration, the frame members configured to be connected to the adjacent frame members with connectors behind the weatherproof flexible sheeting;

the upper and second-side frame members each comprising an outward-facing fastener strip attached to exterior faces thereof; and, wherein, the weatherproof flexible sheeting comprises a flexible extension comprising overlap flap portions extending in unsecured fashion beyond respective edges of the first-side frame member and of the bottom frame member, each overlap flap portion comprising an inward-facing fastener strip on an interior face thereof.

2. The modular weather shelter system of claim 1, wherein the inward-facing fastener strip on the first-side overlap flap portion of a first panel of the plurality of panels corresponds to the outward-facing fastener strip on an adjacent second-side frame member of a second panel of the plurality of panels, and wherein the inward-facing fastener strip on the bottom side overlap flap portion of the first panel corresponds to the outward-facing fastener strip on the upper frame member of a third panel of the plurality of panels, such that the overlap flap portions of the flexible sheeting on the first panel can accordingly be secured to the exterior face of the upper frame member of the second panel beneath the first panel, and to the exterior face of the second-side frame member of the third panel next to the first panel.

3. The modular weather shelter system of claim 2, wherein at least two of the panels are joined vertically to form a shelter wall comprising at least one lower panel and one upper most panel, and wherein said at least one lower panel is joined at its upper end to a loser end of said uppermost panel in the shelter wall at an inward angle to lean against a building to form a shelter roof.

4. The modular weather shelter system of claim 1, wherein the overlap flap portions form an L-shaped extension of the flexible sheeting material beyond the frame.

* * * * *